US005203490A

United States Patent [19]

Roe

[11] Patent Number: 5,203,490

[45] Date of Patent: Apr. 20, 1993

[54] HOT CUP WITH HEAT-INSULATING HAND-GRIP

[76] Inventor: Mark E. Roe, 3558 SE. Morrison St., Portland, Oreg. 97214

[21] Appl. No.: 904,264

[22] Filed: Jun. 25, 1992

[51] Int. Cl.[5] ..... B65D 3/00

[52] U.S. Cl. ..... 229/1.5 B; 229/1.5 H

[58] Field of Search ..... 229/1.5 B, 1.5 H; 220/737, 738, 94 A

[56] References Cited

U.S. PATENT DOCUMENTS

| | | | |
|---|---|---|---|
| 1,999,878 | 4/1935 | La Bombard | 229/1.5 B |
| 2,028,566 | 1/1936 | Seipel et al. | 229/1.5 H |
| 2,070,414 | 2/1937 | Snell | 229/1.5 H |
| 2,454,906 | 11/1948 | Amberg | 229/1.5 B |
| 2,661,889 | 12/1953 | Phinney | 229/1.5 B |
| 2,775,382 | 12/1956 | Kayat | 229/1.5 B |
| 3,104,788 | 9/1963 | Wood | 229/1.5 H |
| 3,357,623 | 12/1967 | Wommelsdorf | 229/1.5 B |
| 3,908,523 | 9/1975 | Shikaya | 229/1.5 B |
| 4,548,349 | 10/1985 | Tunberg | 220/738 |
| 4,685,583 | 8/1987 | Noon | 229/1.5 H |

FOREIGN PATENT DOCUMENTS

| | | | |
|---|---|---|---|
| 2330767 | 1/1975 | Fed. Rep. of Germany | 229/1.5 B |
| 2716351 | 10/1977 | Fed. Rep. of Germany | 229/1.5 B |
| 558159 | 1/1975 | Switzerland | 229/1.5 H |

*Primary Examiner*—Gary E. Elkins

*Attorney, Agent, or Firm*—Milton S. Gerstein

[57] ABSTRACT

A hot cup made of paper has a handle-section that extends approximately 180 degrees about the circumference of the exterior surface of the hot cup. The handle-section is provided with a plurality of punched-out securing tabs, by which the handle-section is permanently connected to respective surface-portions of the exterior surface of the hot cup. Each tab is comprised of two sections: A first, flat section which is actually connected to the respective surface-portion of the exterior surface of the cup, and a second section connected to the first section by a fold-line, so that the second section of each tab may be rotated with respect to the first section. This arrangement allows the handle section to lie flat against the exterior surface of the cup when the cup is not being used, and allows a number of these cups to be stacked one inside the other for storage and shipping. This arrangement also allows one to pull the handle-section away from its flush, surface-to-surface contact with the exterior surface of the cup, so that, except for the first sections of the tabs, the handle-section is spaced from the exterior surface of the cup. This spacing of the handle-section allows a person to hold the cup by gripping the spaced handle-section, whereby the air between the cup's exterior surface and the handle-section provides a thermal barrier to the heat emanating from the hot liquid contents in the cup proper.

20 Claims, 3 Drawing Sheets

HOT CUP WITH HEAT-INSULATING HAND-GRIP

BACKGROUND OF THE INVENTION

The present invention is directed to a cup used for hot liquids, such as coffee, tea, soup, and the like. These cups have usually been made of plastic, such as polystyrene, which provides its own, inherent heat-insulation, so that a person may grip the cup with his hand about the exterior surface of the cup, even though the liquid contents may be very hot. However, these plastic cups are not biodegradable, and, therefore, in some communities, are being banned from use.

In those communities that have banned plastic hot cups, the plastic hot cups have been replaced by hot cups made of paper, which preceded the plastic cups in use. However, since paper hot cups do not provide much inherent heat insulation, it is difficult to hold the cup with one's hand about the exterior surface of the cup when the liquid contents are very hot. One solution to this problem has been the well-known, fold-out handle comprised of two tabs that are folded out away from the cup's exterior surface, with each tab having a hole therein for the insertion of a finger, by which the cup may be held. However, the fold-out handle allows the cup to be held and supported by just one finger, which is an unstable, uncomfortable support that is relatively difficult to maintain. Furthermore, if the tabs had not been folded out prior to the hot liquid's emplacement into the cup, it is difficult to fold out these tabs without some spillage.

SUMMARY OF THE INVENTION

It is, therefore, the primary objective of the present invention to provide a paper hot cup with a paper, hand-grasping handle that allows for the hot cup to be held by a person's hand, for a safer, more stable, and easier gripping of the hot cup.

It is another primary objective of the present invention to provide such a hot cup in which the hand-grasping handle is spaced from the exterior surface of the hot cup, so that heat from the hot liquid contents is not transmitted to the hand holding the hot cup.

It is still another primary objective of the present invention to provide such a hot cup with a thermal-barrier, hand-grasping handle, which hot cup and which handle are made integrally from one piece of paper product, such as paper, cardboard, plastic-coated paper, and the like.

It is another primary objective of the present invention to provide such a hot cup in which the spacing of the hand-grasping handle from the exterior surface of the hot cup, in order to provide a thermal barrier to the heat from the hot liquid contents of the cup, is achieved automatically when one grips the cup about the thermal-barrier handle and lifts the cup up.

It is another primary objective of the present invention to provide such a hot cup in which the hand-grasping handle lies flush against the exterior surface of the hot cup in order that the cups may be stacked one inside another for purposes of storage and shipping.

Toward these and other ends, the hot cup of the invention is preferably made of paper or plastic coated paper, and has a handle-section made of the same material, which handle-section extends approximately 180 degrees about the circumference of the exterior surface of the hot cup, with a height of approximately 50% of the height of the cup proper. The handle-section is arcuate in shape, and is provided with a plurality of punched-out securing tabs, by which the handle-section is permanently connected to respective surface-portions of the exterior surface of the hot cup. Each tab is comprised of two sections: A first, flat section which is actually connected to the respective surface-portion of the exterior surface of the cup, and a second section connected to the first section by a fold-line, so that the second section of each tab may be rotated with respect to the first section. This arrangement allows the handle section to lie flat against the exterior surface of the cup when the cup is not being used, and allows a number of these cups to be stacked one inside the other for storage and shipping. This arrangement also allows one to pull the handle-section away from its flush, surface-to-surface contact with the exterior surface of the cup, so that, except for the first sections of the tabs, the handle-section is spaced from the exterior surface of the cup. This spacing of the handle-section allows a person to hold the cup by gripping the spaced handle-section, whereby the air between the cup's exterior surface and the handle-section provides a thermal barrier to the heat emanating from the hot liquid contents in the cup proper. Since one grips the handle-section and not the cup proper, the weight of the cup and its liquid contents retains the cup proper in its spaced-apart relationship with the handle-section, by causing downward-directed moments that keep the first and second sections of all of the tabs of the handle-section in their relatively-rotated positions.

BRIEF DESCRIPTION OF THE DRAWINGS

The invention will be more readily understood with reference to the accompanying drawing, wherein.

DETAILED DESCRIPTION OF THE INVENTION

Figure 2:
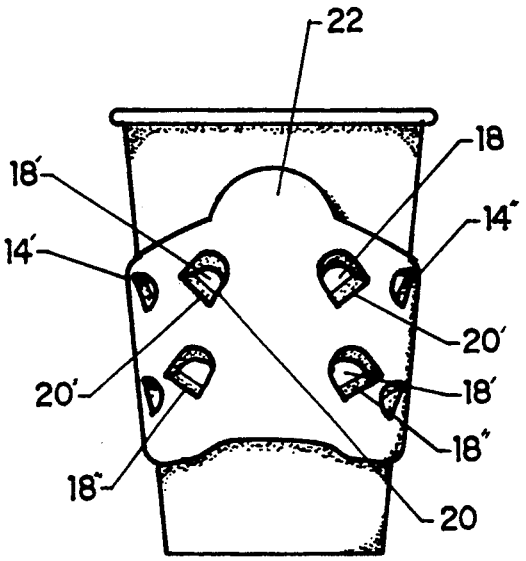
FIG. 2 is a front elevational view of the hot cup of the invention wit the handle-section in its spaced-apart, pulled out position.
Figure 1:
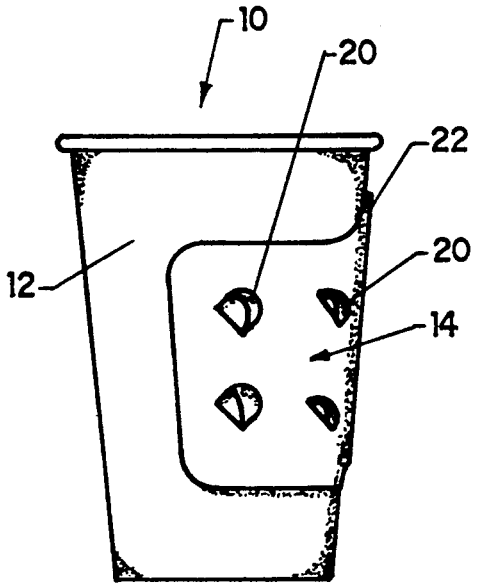
FIG. 1 is a side elevational view of the hot cup of the invention, with the handle-section in its spaced-apart, pulled out position ready for use.
Figure 3:
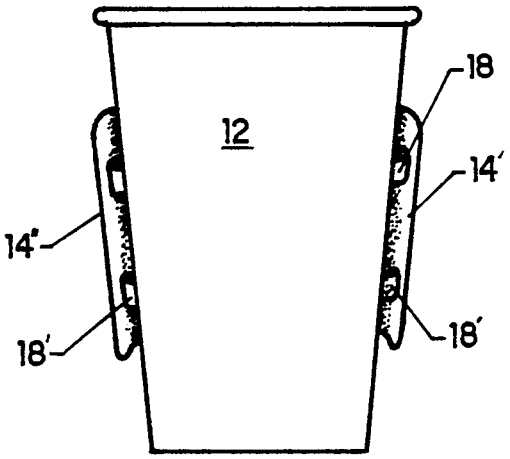
FIG. 3 is a rear elevational view of the hot cup of the invention of FIG. 1.

Referring to the drawings in greater detail, and to FIGS. 1 through 6 for now, the hot cup of the invention is indicated generally by reference numeral 10. The cup 10 is preferably made of paper, or paper products, and has a main, hollow receptacle-portion 12 in which is stored hot liquid, such as coffee, tea, soup, and the like. In cooperative relationship with the main, hollow receptacle-portion 12 is a handle-section 14. The handle-section 14 is also preferably made of the same material as the main, hollow receptacle-portion, and is generally arcuate in shape, so as to span approximately half the arcuate distance of the circumference of the main, hollow receptacle-portion 12. The handle-section 14 has a plurality of punched-out tabs 18, which, after having been punched out, leave holes 20. As seen in the drawings, the tabs 18 are arranged in two sets: A first set of four tabs 18 for a first end-portion 14' of the handle-section 14, and a second set of four tabs 18 for a second end-portion 14" of the handle-section. The handle-section 14 proper is permanently connected to the exterior surface of the main, hollow receptacle-portion 12 by means of the tabs 18.

Each tab 18 is made up of two sections: A first section 18', which is actually the part of the tab 18 that is permanently connected to a respective surface-portion of the exterior surface of the main, hollow receptacle-portion 12, and a second section 18", which has a first end connected to the first section 18' via a fold-line 20, and a second end connected to the handle-section proper via a fold line 20'. The fold-line 20 allows the first section 18" to rotate relative to the first section 18'. As can be seen in FIG. 2, each second section 18" is generally located vertically below its corresponding first section 18'. In the preferred form of the invention, each tab 18 is generally oriented at an acute angle with the respect to the vertical, in order to add strength to the tabs' support-capacity, and to ensure that, when the handle-section is pivoted upwardly, as explained below, the handle-section proper will be spaced from the exterior surface of the main, hollow receptacle-portion 12. It is noted that the tabs 18 of the first set are angularly mounted in the mirror image of the tabs of the second set, as clearly seen in FIG. 2. Since the second sections 18" are located below the first sections 18', the handle-section proper is allowed to rotate upwardly via the rotation of the second sections 18" about the fold-lines 20, and its own rotation about the fold-lines 20'. Since the material from which the handle-section 14 is made is paper, it is readily deformed, whereby the angled mounting of the tabs 18 may easily and readily accommodate such pivotal movement of the handle-section proper, in order to ensure that the handle-section proper is spaced from the exterior surface of the main, hollow receptacle-portion 12. It is, of course, possible to orient the tabs 18 in a vertical manner, but such an arrangement requires stiffer material to ensure that, when the handle-section proper is rotated up about the fold-lines, the first and second sections 18',18" do not simply fold in on themselves in a flush, surface-to-surface contact, which would effectively negate the spacing of the handle-section proper from the exterior surface of the main, hollow receptacle-portion 12, thus compromising the thermal barrier provided by the air space therebetween. It is also noted that the handle-section 14 has an upper, projecting piece 22, which serves as a pull-tab by which the handle-section is rotated about the fold-lines 20, 20', as one grabs the one piece 22, and then pulls it upwardly.

Figure 4:
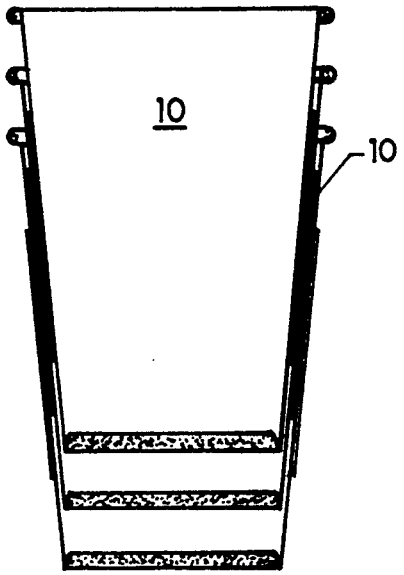
FIG. 4 is a rear elevational view showing a plurality of hot cups stacked one inside the other for storage and shipping, with the handle-section of each cup being in its flush position, where it is in surface-to-surface contact with the exterior surface of the cup proper.
Figure 5:
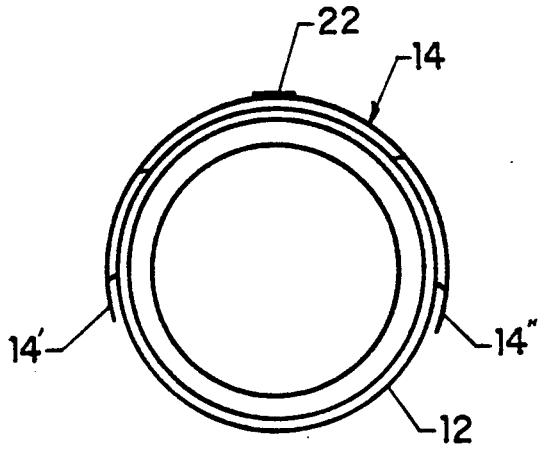
FIG. 5 is a top view of the cup of FIG. 1.
Figure 11:
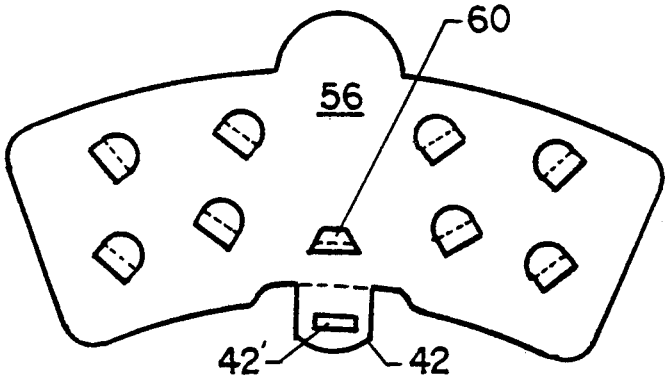
FIG. 11 is a plan view of the handle-section of the cup of FIG. 7.

When using the cup 10, before or after the cup has been filled with hot liquid, one pulls up on the pull-tab 22 to rotate the handle-section 14 about the fold-lines 20, 20'. Such rotation inherently spaces the handle-section 14 from the exterior surface of the main, hollow receptacle-portion 12, whereby the air space between the handle-section and the exterior surface of the cup provides a thermal-insulating barrier to the heat from the hot liquid in the cup. Since the arcuate extent of the handle-section 14 is approximately 180 degrees about the main, hollow receptacle-portion 12, one's entire hand may, therefore, be used for holding the cup 10 in a much more secure and safe manner. When holding the handle-section 14 when the cup is filled with hot liquid, the weight of the liquid biasses the main, hollow receptacle-portion 12 downwardly, thereby reinforcing and retaining the relative, upwardly-rotated position of the handle-section proper and the spaced-apart positioning thereof. Thus, the arrangement of the invention provides an inherent, self-biassing force to keep the handle-section from returning to its closed, nonuse, downwardly-rotated position, and, thus, inherently prevents contact against the hot exterior surface of the main, hollow receptacle-portion 12. In addition, by virtue of the fact that the handle-section 14 may be rotated downwardly, where it is flush against the exterior surface of the main, hollow receptacle-portion 12, a plurality of cups 10 may be stacked one inside the other, as seen in FIG. 4. This is advantageous for storage and shipping the cups 10.

Figure 6:
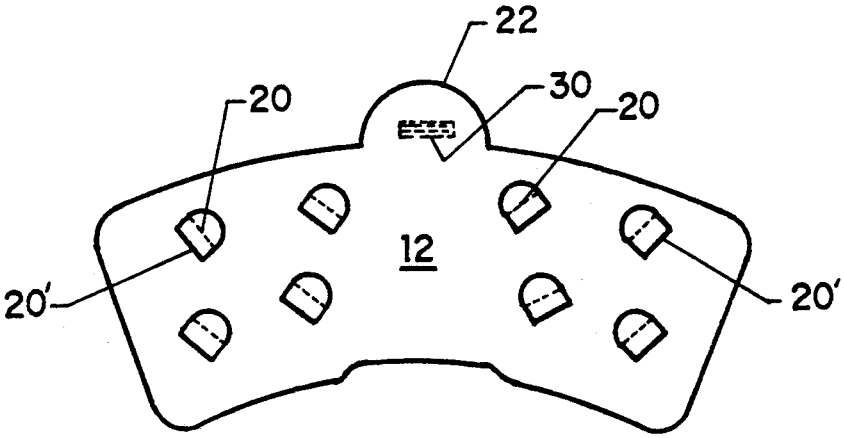
FIG. 6 is a plan view of the handle-section of the cup of the invention.
Figure 8:
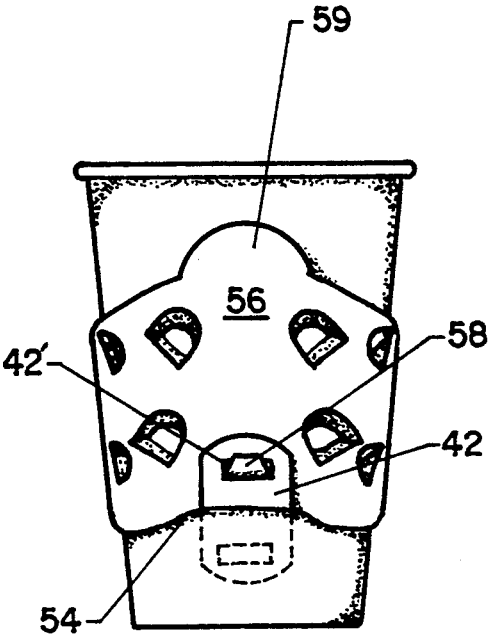
FIG. 8 is a front elevational view of the hot cup of the invention wit the handle-section in its spaced-apart, pulled out position.

As seen in FIG. 6, the inside-surface of the pull-tab 22 may be provided with a glue-line 30, which may be used for removably securing the pull-tab 22 against the exterior surface of the main, hollow receptacle-portion 12 after the handle-section 14 has been rotated upwardly to its spaced-apart, operative position. By pushing the top of the pull-tab 22 against the main, hollow receptacle-portion 12, the tab 22 is retained in its upward position, to thus retain the handle-section in its upwardly-rotated, spaced-apart, operative position.

Figure 7:
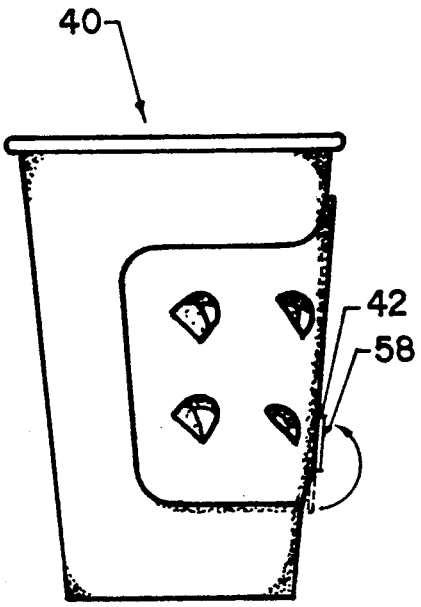
FIG. 7 is a side elevational view of a second embodiment of the hot cup of the invention, with the handle-section in its spaced-apart, pulled out position ready for use, in which is provided a latch for retaining the handle-section in its pulled-out, spaced-apart position.
Figure 9:
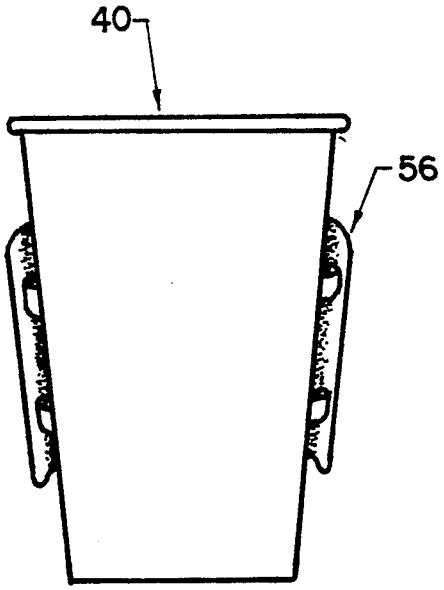
FIG. 9 is a rear elevational view of the hot cup of the invention of FIG. 7.
Figure 10:
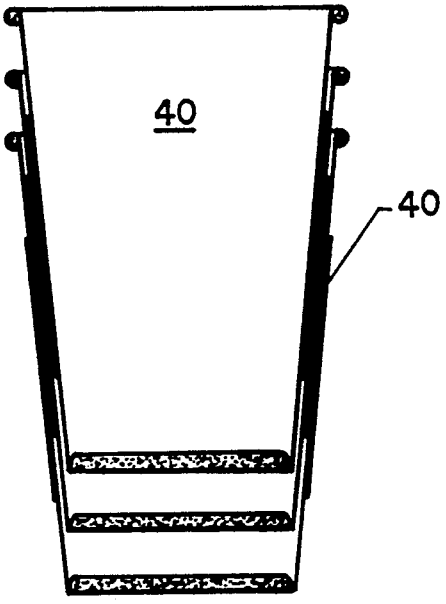
FIG. 10 is a rear elevational view showing a plurality of hot cups stacked one inside the other for storage and shipping, with the handle-section of each cup being in its flush position, where it is in surface-to-surface contact with the exterior surface of the cup proper.

FIGS. 7-11 show a modification 40. The hot cup 40 is similar to the cup 10, with the exception of the additional locking member 42 to replace the glue-line 30, or to supplement it. The locking member 42 is comprised of a pivotal ear, or flap, which is connected to the lower, front edge-surface 54 of handle-section 56. The ear 42 is connected to the lower edge-surface 54 by a horizontal fold-line, so that it may be pivoted in the vertical direction. The ear 42 is provided with a cut-out 42' adjacent the end thereof remote from the end connected to the edge-surface 54. The main, hollow receptacle-portion of the cup 40 has a projecting detent-member 58 that is receivable first through a cutout 60 formed in the bottom portion of the handle-section, and then is received through the cut-out 42' when the ear 42 is in its upwardly-pivoted position. The cutout 60 is large enough so that the detent member always projects through it, regardless of the position of the handle-section. The detent-member extends from the exterior surface of the handle-section 56 at an acute angle with respect to the vertical, as seen in FIG. 7, and is situated such that the cutout 42' cannot receive it unless the handle-section has first been lifted and rotated to its operative, upwardly-rotated position. The detent-member prevents the ear 42 from rotating downwardly, and, therefore, retains the entire handle-section in its upward, spaced-apart, operative position, since the cutout 42' provides a tight-fitting opening for the upper end of the detent-member. The ear 42 and detent-member 58 are made of the same material as that of the rest of the cup 40. The cup 40 may also use the pull-flap 59 for retaining the handle-section in its upward, space-apart position, in addition to, or in place of, the ear 42. The flap 59 may be folded down so that it mat be tucked inside the detent-member 58. Of course, the flap 59 must have great enough length so that its outer edge portion may reach the space between the detent-member 58 and the outer surface-face of the handle-section 56. The location of the ear 42 is such so as to accommodate both the ear 42 and flap 59. When just the flap 59 is used for retaining the handle-section, then the detent-member 58, and the associated cutout in the handle-section 56, may be located vertically closer to the flap 59, thereby obviating the need for providing a much longer flap 56.

As stated above, the cup 10 or 40 is preferably made of paper or from paper products, such as cardboard, and the like, since they are biodegradable. However, of course, the same concept may be applied to the cups made of other material, such as the conventional polystyrene cup, and the like. In addition, the cup 10 or 40 may be used as a cold cup as well.

While a specific embodiment of the invention has been shown and described, it is to be understood that numerous changes and modifications may be made therein without departing from the scope, spirit and intent of the invention as set forth in the appended claims.

What I claim is:

1. In a cup for holding liquid comprising a main, hollow receptacle-portion having an interior surface and an exterior surface, and a handle-section, wherein the improvement comprises:

said handle-section comprising an arcuate, hand-gripping member spanning about a circumferential portion of said main, hollow receptacle-portion, and a mounting means for connecting said hand-gripping member to portions of said main, hollow receptacle-portion;

said mounting means rotatably mounting said hand-gripping member relative to said main, hollow receptacle-portion, whereby said hand-gripping member may be rotated to a position spaced from the exterior surface of said main, hollow receptacle-portion;

said mounting means comprising a plurality of tabs, each said tab having a first section connected to a respective portion of said exterior surface of said main, hollow receptacle-portion, and a second section having a first end connected to said first section, and a second end connected to a respective portion of said hand-gripping member; said second section of each of said plurality of tabs being pivotal with respect to the respective said first section, whereby said hand-gripping member may be rotated relative to said main, hollow receptacle-portion and be spaced therefrom, in order to provide a thermal-insulating, air-space barrier;

each said tab being punched out from a respective portion of said hand-gripping member, said hand-gripping member having a plurality of cut-outs formed when said tabs were punched out.

2. The cup according to claim 1, wherein said cup is made of paper product, and said first end of said second section of each said tab is connected to respective said first section by a first fold-line, and said second end of said second section of each said tab is connected to a respective said portion of said hand-gripping member by a second fold-line, said fold-lines allowing relative rotation.

3. The cup according to claim 2, wherein each of said plurality of tabs comprises a central, longitudinal axis, said central, longitudinal axis being oriented at an acute angle with respect to the vertical, whereby said first and second sections of said tabs are provided greater strength thereby.

4. The cup according to claim 3, wherein said plurality of tabs comprise a first set of said tabs and a second set of said tabs; said hand-gripping member having a first end portion and a second end portion; said first set of tabs being connected to said first end portion, and said second set of tabs being connected to said second set of tabs.

5. The cup according to claim 4, wherein each said central, longitudinal axis of said tabs of said first set extends at an acute angle that is the mirror image to that of each of said tabs of said second set; said second section of each said tab being relatively below said first section of the respective said tab, whereby said hand-gripping member rotates relatively approximately in the vertical direction.

6. The cup according to claim i, wherein said hand-gripping member extends arcuately about the exterior surface of said main, hollow receptacle-portion for approximately 180 degrees.

7. The cup according to claim 1, wherein said handle-section further comprises latching means for retaining said hand-gripping in its rotated, spaced-apart position.

8. The cup according to claim 7, wherein said latching means for retaining said hand-gripping member in its rotated, spaced-apart position comprises a detent-member projecting from a portion of the exterior surface of said main, hollow receptacle-portion; said hand-gripping member comprising a cooperating member for cooperating with said detent-member, whereby said detent-member retains said hand-gripping member in its rotated, spaced-apart position.

9. The cup according to claim 1, wherein said hand-gripping member further comprises an upper edge surface and a pull-tab projecting from said upper edge-surface, said pull-tab being used for causing the relative rotation of said hand-gripping member with respect to said main, hollow receptacle-portion by pulling up said pull-tab.

10. The cup according to claim 2, wherein each said tab is capable of being laid flush against the exterior surface of said main, hollow receptacle-portion when said handle-section is in its downwardly-rotated position, whereby said handle-section is flush against said exterior surface of said main, hollow receptacle-portion, whereby a plurality of said cups may be stacked one inside the other.

11. In a cup for holding liquid comprising a main, hollow receptacle-portion and a handle-section, wherein the improvement comprises:

said handle-section comprising an arcuate, hand-gripping member spanning about a circumferential portion of said main, hollow receptacle-portion, and a mounting means for connecting said hand-gripping member to portions of said main, hollow receptacle-portion;

said mounting means rotatably mounting said hand-gripping member relative to said main, hollow receptacle-portion, whereby said hand-gripping member may be rotated to a position spaced from an exterior surface of said main, hollow receptacle-portion;

said handgripping member extending arcuately about the exterior surface of said main, hollow receptacle-portion for approximately 180 degrees.

12. In a cup for holding liquid comprising a main, hollow receptacle-portion having an interior surface and an exterior surface, and a handle-section, wherein the improvement comprises:

said handle-section comprising an arcuate, hand-gripping member spanning about a circumferential portion of said main, hollow receptacle-portion, and a mounting means for connecting said hand-gripping member to portions of said main, hollow receptacle-portion;

said mounting means rotatably mounting said hand-gripping member relative to said main, hollow receptacle-portion, whereby said hand-gripping member may be rotated to a position spaced from the exterior surface of said main, hollow receptacle-portion;

said handle-section further comprising latching means for retaining said hand-gripping in its rotated, spaced-apart position;

said latching means for retaining said hand-gripping member in its rotated, spaced-apart position comprising a detent-member projecting from a portion of said exterior surface of said main, hollow receptacle-portion; said hand-gripping member comprising a cooperating member for cooperating with said detent-member, whereby said detent-member retains said hand-gripping member in its rotated, spaced-apart position.

13. The cup according to claim 12, wherein said cooperating member comprises a first end connected to said hand-gripping member, said first end being rotatable with respect to said hand-gripping member from a downward position to an upwardly-rotated position; said cooperating member having a second free end, and a hole formed therein for receiving therethrough said detent-member when said cooperating member has been rotated to said upwardly-rotated position.

14. The cup according to claim 13, wherein said detent member is located high enough on said exterior surface of said main, hollow receptacle-portion at a position such that said hole of said cooperating member cannot receive said detent-member unless said hand-gripping member has been rotated to its upwardly-rotated, spaced-apart position; said detent-member having a first end connected to said exterior surface of said main, hollow receptacle-portion, and a second, upper, free end that is spaced upwardly from the lower edge surface of said hand-gripping member, the distance from said lower edge-surface to said second end of said cooperating member being less than the distance from said lower edge-surface to said second end of said detent-member, so that said hand-gripping member must be in its upwardly-rotated, spaced-apart position in order for the hole of said cooperating member to pass therethrough said second end of said detent-member.

15. In a cup for holding liquid comprising a main, hollow receptacle-portion having an interior surface and an exterior surface, and a handle-section, wherein the improvement comprises:

said handle-section comprising an arcuate, hand-gripping member spanning about a circumferential portion of said main, hollow receptacle-portion, and a mounting means for connecting said hand-gripping member to portions of said main, hollow receptacle-portion;

said mounting means rotatably mounting said hand-gripping member relative to said main, hollow receptacle-portion, whereby said hand-gripping member may be rotated to a position spaced from the exterior surface of said main, hollow receptacle-portion;

said hand-gripping member further comprising an upper edge surface and a pull-tab projecting from said upper edge-surface, said pull-tab being used for causing the relative rotation of said hand-gripping member with respect to said main, hollow receptacle-portion by pulling up said pull-tab.

16. A method of using a cup, which cup comprises a main, hollow receptacle-portion having an interior surface and an exterior surface, and a handle-section, which handle-section comprises an arcuate, hand-gripping member spanning about a substantial circumferential portion of the main, hollow receptacle-portion, and a mounting means for connecting the hand-gripping member to portions of the main, hollow receptacle-portion, the mounting means rotatably mounting the hand-gripping member relative to said main, hollow receptacle-portion, said method comprising:

(a) rotating the hand-gripping member of the handle-section in a first direction via the mounting means relative to the main, hollow receptacle-portion;

(b) said step (a) comprising spacing the hand-gripping member from the exterior surface of the main, hollow receptacle-portion as the hand-gripping member from the exterior surface of the main, hollow receptacle-portion as the hand-gripping member is rotated relative to the main, hollow receptacle-portion; and (c) said step (b) comprising forming a thermal-insulating barrier of air-space between the hand-gripping member and the main, hollow receptacleportion;

(d) holding the hand-gripping member by hand, in order to hold the cup; and (e) drinking from the cup while performing said step (d);

said step (d) comprising holding the hand-gripping member such that only an exterior surface of the hand-gripping member is contacted by the hand, an interior surface of the hand contacting at least most of the exterior surface of the hand-gripping member, said hand enwraps a hand about the exterior surface of a cup proper without a handle-section in order to hold it.

17. The method according to claim 16, further comprising after said step (c):

(d) rotating the hand-gripping member in a second, opposite direction for bringing the hand-gripping member into contact with the exterior surface of the main, hollow receptacle-portion;

(e) said step (d) comprising abutting said hand-gripping member against the exterior surface of the main, hollow receptacle-portion in a flush, surface-to-surface contact.

18. The method according to claim 17, further comprising:

(f) stacking the cup inside the main, hollow receptacle-portion of another like-cup, whereby the cups may be stored and shipped.

19. The method according to claim 16, further comprising:

(d) latching the hand-gripping member in its relatively rotated position assumed during said step (a), in order to prevent the hand-gripping member from returning from its spaced-apart position.

20. The method according to claim 16, wherein said step (a) comprises rotating the hand-gripping member from a position in which it is in flush, surface-to-surface contact with the main, hollow receptacle-portion to said position of said step (b); said first direction of said step (a) comprising an upward direction.

* * * * *